US006048006A

United States Patent [19]

Antonucci et al.

[11] Patent Number: 6,048,006

[45] **Date of Patent: *Apr. 11, 2000**

[54] RATCHETING PAWL LATCH

[75] Inventors: Jeffrey L. Antonucci, Worcester, United Kingdom; Ralph C. Ulisse, Glassboro, N.J.; Christopher J. Pinkow, Boothwyn, Pa.

[73] Assignee: Southco, Inc., Concordville, Pa.

[ * ] Notice: This patent is subject to a terminal disclaimer.

[21] Appl. No.: 09/299,246

[22] Filed: Apr. 26, 1999

Related U.S. Application Data

[63] Continuation-in-part of application No. 09/050,806, Mar. 30, 1998, Pat. No. 5,927,772, which is a continuation-in-part of application No. 08/928,266, Sep. 12, 1997, abandoned.

[51] Int. Cl.[7] ..... E05B 3/00

[52] U.S. Cl. ..... 292/336.3; 292/DIG. 31; 70/208

[58] Field of Search ..... 70/71, 208; 292/336.3, 292/170, 173, 224, 252, DIG. 31, 38

[56] References Cited

U.S. PATENT DOCUMENTS

| | | | |
|---|---|---|---|
| 4,838,065 | 6/1989 | Weinerman et al. | 70/208 |
| 4,850,208 | 7/1989 | Weinerman et al. | 70/208 |
| 4,911,487 | 3/1990 | Rachocki | 292/216 |
| 4,969,916 | 11/1990 | Weinerman et al. | 70/208 |
| 4,989,907 | 2/1991 | Edmonds et al. | 292/223 |
| 5,046,340 | 9/1991 | Weinerman et al. | 70/208 |
| 5,098,141 | 3/1992 | Bull | 292/252 |
| 5,127,686 | 7/1992 | Gleason et al. | 292/216 |
| 5,234,238 | 8/1993 | Takimoto | 292/216 |
| 5,292,159 | 3/1994 | Sandu et al. | 292/173 |
| 5,299,844 | 4/1994 | Gleason | 292/240 |
| 5,340,174 | 8/1994 | Bender et al. | 292/336.3 |
| 5,413,391 | 5/1995 | Clavin et al. | 292/170 |
| 5,927,772 | 7/1999 | Antonucci et al. | 292/DIG. 31 X |
| 5,927,773 | 7/1999 | Larsen et al. | 292/DIG. 31 X |
| 5,941,104 | 8/1999 | Sadler | 292/DIG. 31 X |

OTHER PUBLICATIONS

Suzuaki Latch (Item 1).
Toyota Latch (Item 2).
Nissan or Mazda Latch (Item 3).
Lexus Latch (Item 4).
Latch (Item 5).
Nissan Latch (Item 6).

*Primary Examiner*—Suzanne Dino Barrett

[57] ABSTRACT

A pawl latch assembly with a spring locking member having its own internal spring force for enabling a force from a handle of the assembly to be transmitted to a pawl to engage or disengage a keeper member for opening and closing of the latch, and further having a lock for securing the latch against unauthorized opening, and a stop to facilitate maintenance of the spring locking member in a locking position when the latch is secured with a lock.

38 Claims, 19 Drawing Sheets

RATCHETING PAWL LATCH

CROSS REFERENCE TO RELATED APPLICATIONS

This is a continuation-in-part of U.S. patent application Ser. No. 09/050,806 filed on Mar. 03, 1998, now U.S. Pat. No. 5,927,772, which is a continuation-in-part of U.S. patent application Ser. No. 08/928,266 filed on Sep. 12, 1997, now abandoned.

BACKGROUND OF THE INVENTION

1. Field of Invention

The present invention relates to the field of latch assemblies.

2. Brief Description of the Prior Art

Latch assemblies are relied on in many applications for securing items, such as panels, together. For example, containers, cabinets, closets, compartments and the like may be secured with a latch. An important use for latches is in the automotive field, where there is a desire and need to access automotive compartments, such as, for example, the trunk or passenger compartments of vehicles, as well as interior compartments such as a glove box.

Various latches for panel closures have been employed where one of the panels such as a swinging door or the like is to be fastened or secured to a stationary panel or compartment body. The prior art devices generally utilize a locking member which is spring loaded externally by one or more separately provided torsion springs. For example, some prior art devices rely upon a lock which comprises rigid metal parts and requires additional biasing members for operation of the assembly.

In addition, it is important to provide a secure latch which can be selectively locked to prevent unauthorized access to a compartment. In addition to a lock cylinder, which can be operated with a key, it is further desirable to provide additional safeguards against unauthorized unlocking, even when the lock cylinder is engaged. A need exists for an improved latch which can be used in connection with compartments, such as the glove box of a vehicle, to secure the contents therein.

SUMMARY OF THE INVENTION

The present invention relates to a latching system for securing two panels together such as those of storage structures in which an enclosure is secured by means of a door or panel which will remain in a closed position until released. An example of a use of the present latching system is in connection with automobile glove boxes or other compartments which are to be secured for storage of items therein.

The present invention provides a novel ratcheting pawl latch assembly with a spring locking member which provides the locking member with its own internal spring force when the locking member is deflected by an actuating lever. The actuating lever can be provided in the form of a handle or paddle. The spring locking member enables a force from a handle of the latch assembly to be transmitted to a pawl which selectively engages and disengages a keeper member. When the keeper member engages the pawl, the pawl is rotated until the locking member slips in behind it. The pawl is provided with a torsional spring member which causes a force load from the spring member to be supplied to the pawl.

When the paddle is rotated or swingably moved away from the panel surface to which it is attached, the spring locking member is engaged and is lowered and retracted out of the way of the pawl. The pawl is disengaged from the keeper with the actuation of the paddle, which causes the spring locking member to release from its engagement with the pawl, whereupon the torsional pawl spring member which provides a force load to the pawl, releases its force load to return the pawl to its unlocked position away from engagement with the keeper. The keeper wire is thereby disengaged and the paddle or handle is reset with a spring loading mechanism to its original position.

The present invention also provides a locking mechanism in which a key can selectively lock and unlock the latch assembly. In addition, the present invention also provides a means whereby the handle or paddle can be offset from the pawl and locking member. This offers greater flexibility for selecting a location for the latch and for greater alternative placements when utilizing this latch as described herein.

The locking of the latch is further facilitated by providing a retaining mechanism to hold the locking member in engagement with the pawl when the latch is locked.

It is a principal object of the present invention to provide a novel latch assembly which is selectively engagable with a keeper member, and includes a spring locking member which is spring-loaded with its own spring force for engaging and releasing a pawl from a keeper member when a handle is actuated.

It is another object of the present invention to provide a locking member which is comprised of spring steel or plastic.

Another object of the present invention is to provide a lock which can be operated with a key or other operator, such as radio, infrared, electronic or other means, which selectively engages the locking member against movement.

Another object of the present invention is to provide a locking mechanism which will facilitate the maintenance of a locking member in latched engagement with a pawl to facilitate securing of the latch against an unauthorized opening when the latch is in a locked condition.

It is a further object of the present invention to accomplish the above objects by providing an interfering element which prevents release of the locking member from engagement with the pawl when the locking member is in a locked position.

Another object of the present invention to provide a locking member which is securely retained in the latch assembly to minimize inadvertent shifting from vibrations acting on the latch.

BRIEF DESCRIPTION OF THE DRAWING FIGURES

Figure 1:
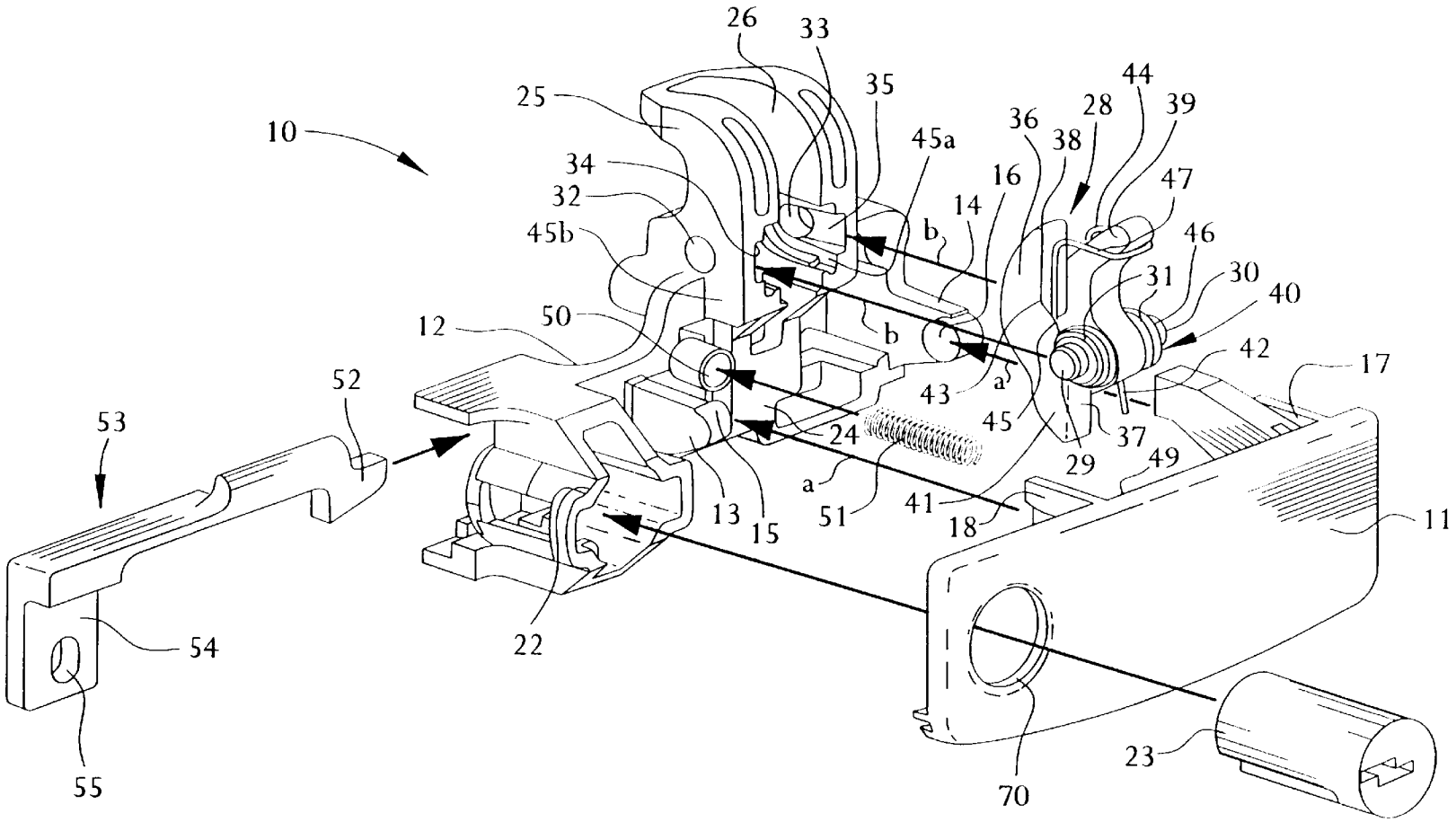
FIG. 1 is a right front perspective view of a ratcheting pawl latch according to the present invention showing the latch housing with the pawl and handle in exploded view therefrom.
Figure 5A:
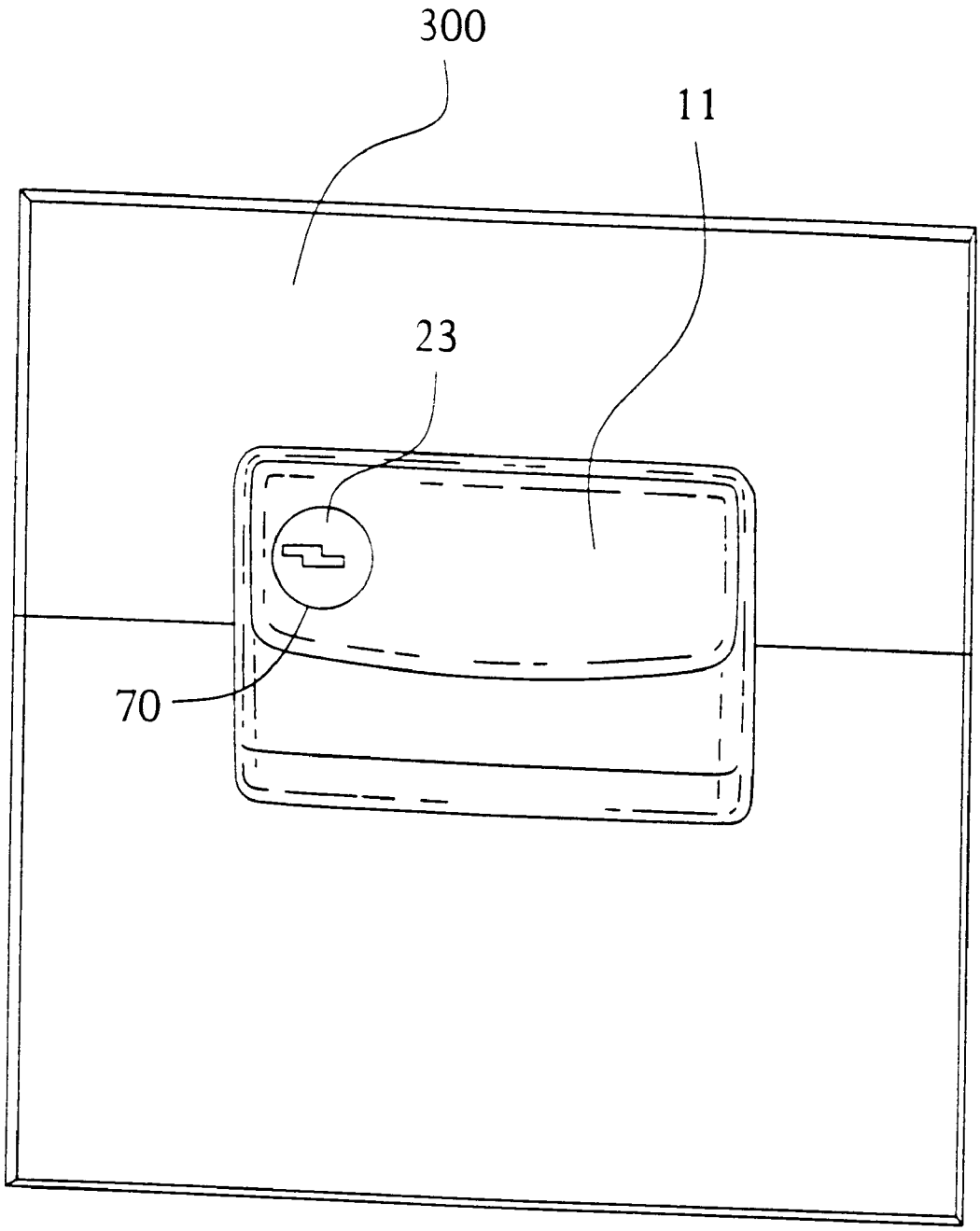

FIG. 5*a* is a front elevation view showing the latch of FIG. 1 in an installed condition.

Figure 5B:
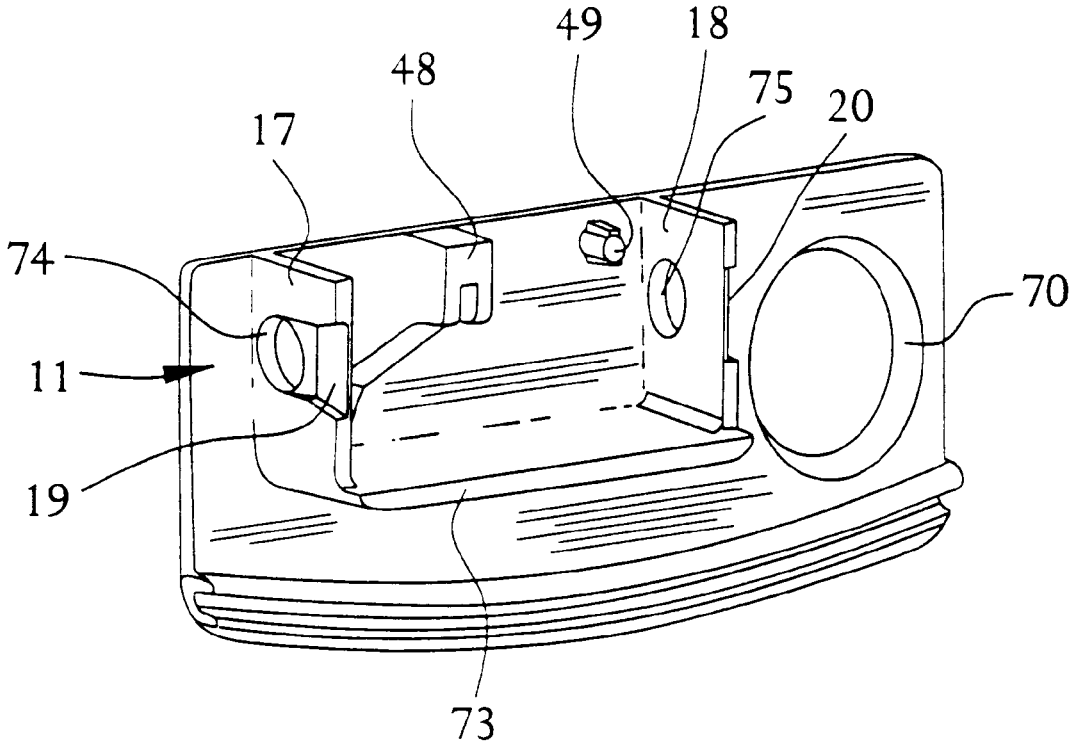

FIG. 5*b* is a left rear perspective view of the handle of the latch shown in FIG. 5*a*.

Figure 6A:
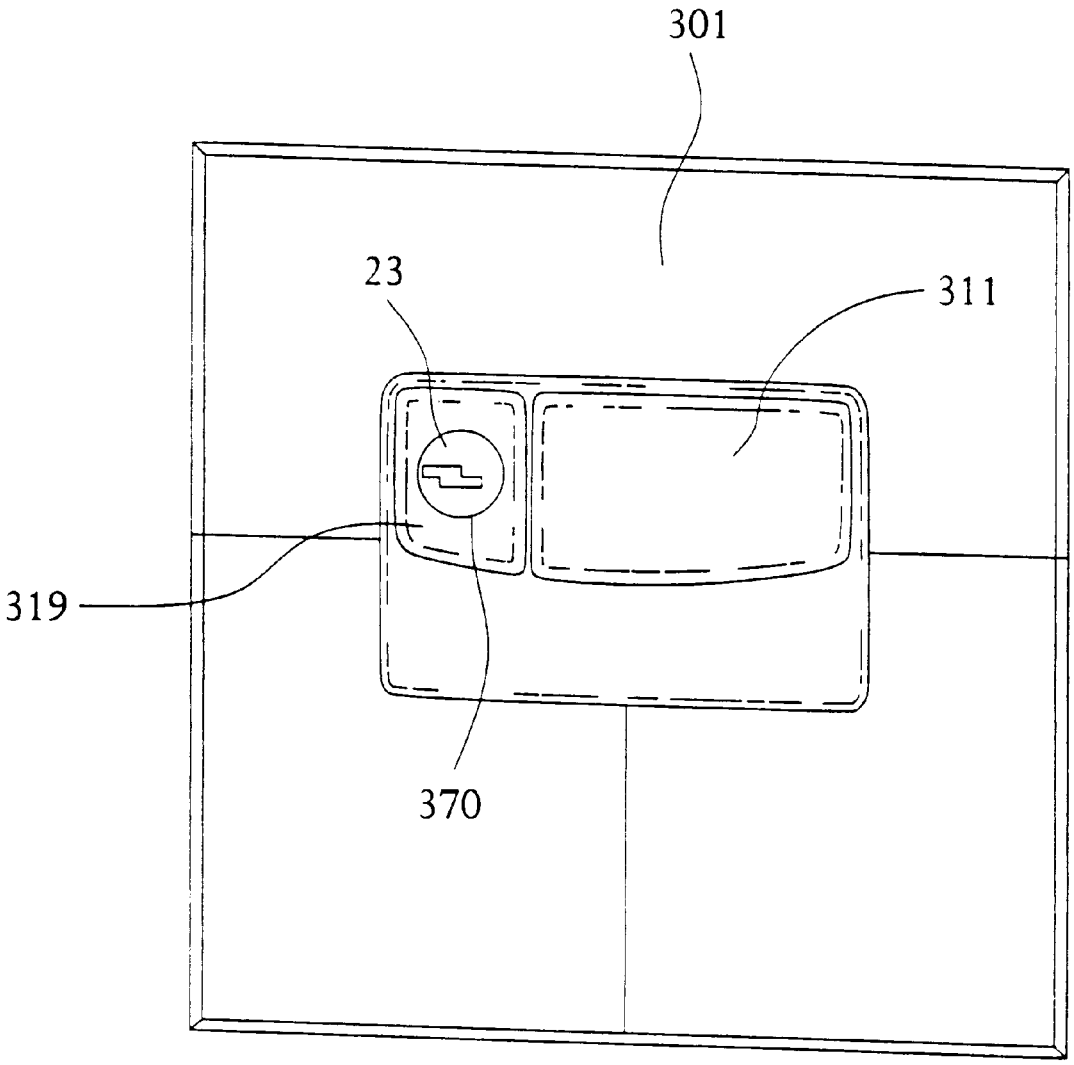

FIG. 6*a* is a front elevation view of the latch according to the present invention in an installed condition, with an alternate handle embodiment.

Figure 6B:
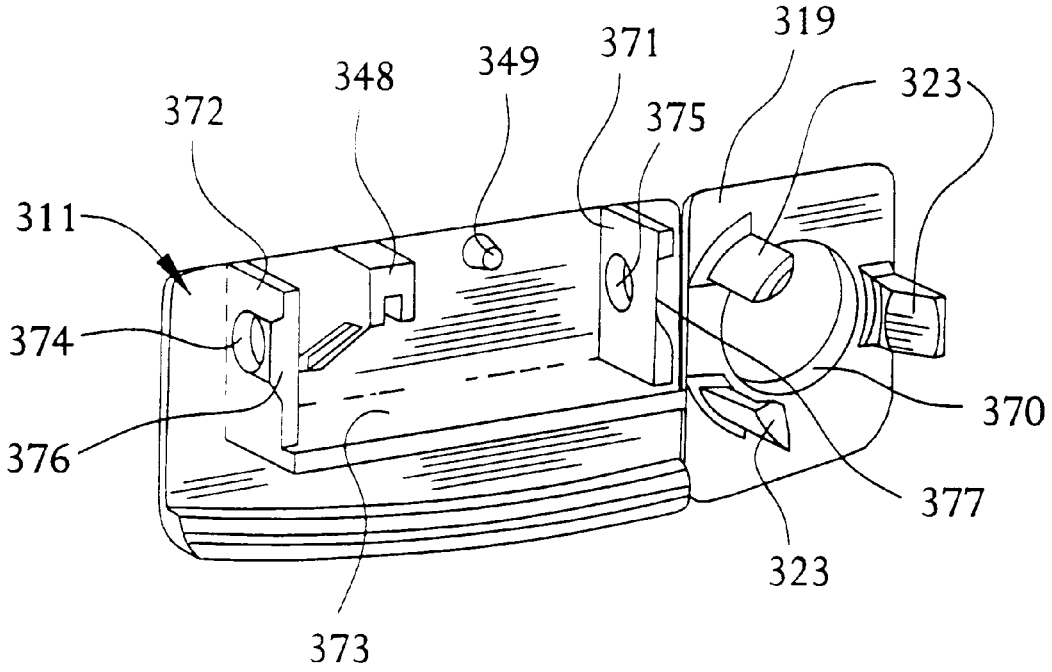

FIG. 6*b* is left rear perspective view of the handle of the latch shown in FIG. 6*a*.

Figure 7:
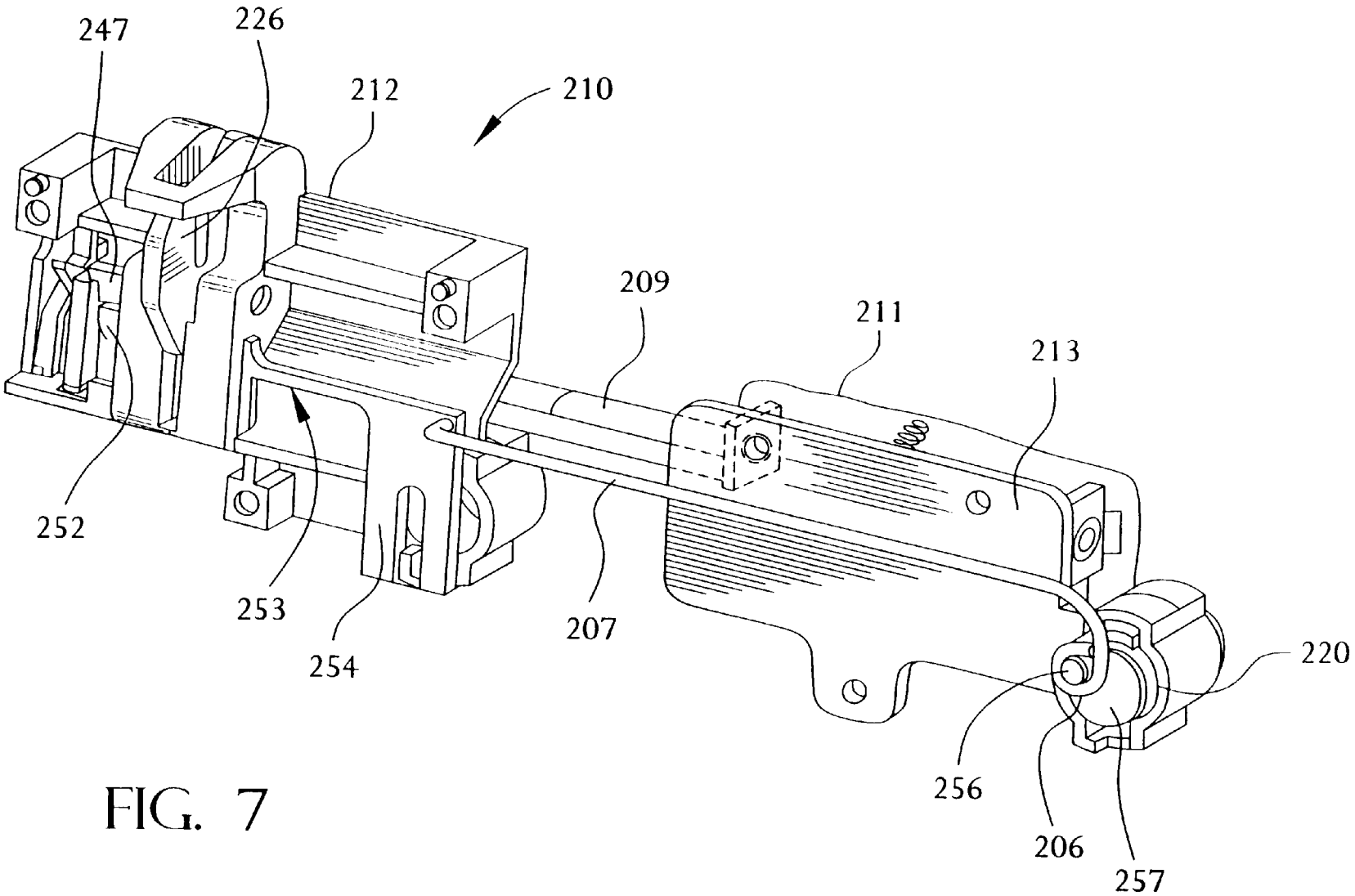

FIG. 7 is a right rear perspective view of a first alternate embodiment of the latch assembly of FIG. 1 showing the latch assembly having an offset paddle with locking means in the closed position.

Figure 8:
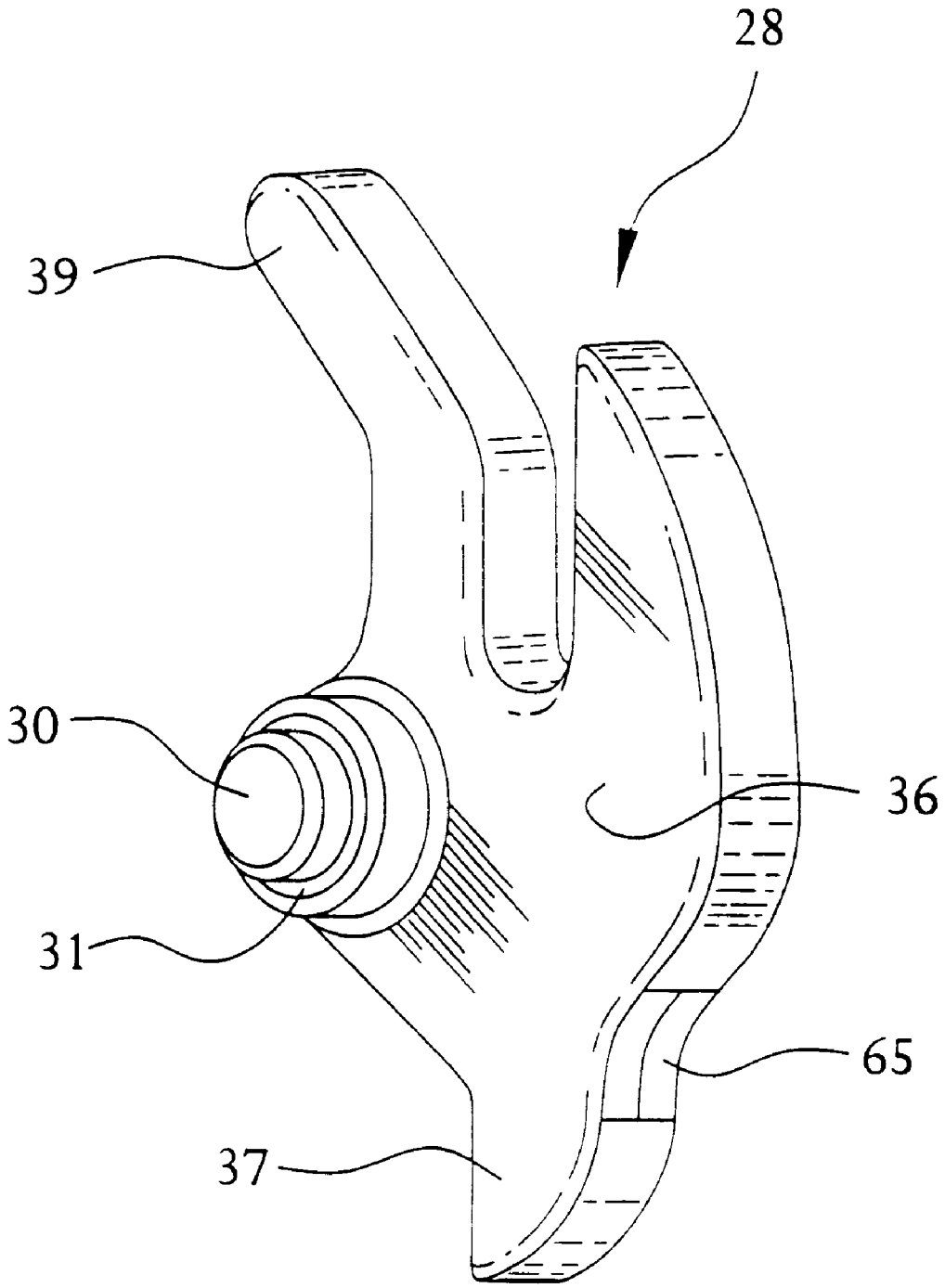

FIG. 8 is a left front perspective view of the pawl of the latch assembly of FIG. 1.

Figure 9:
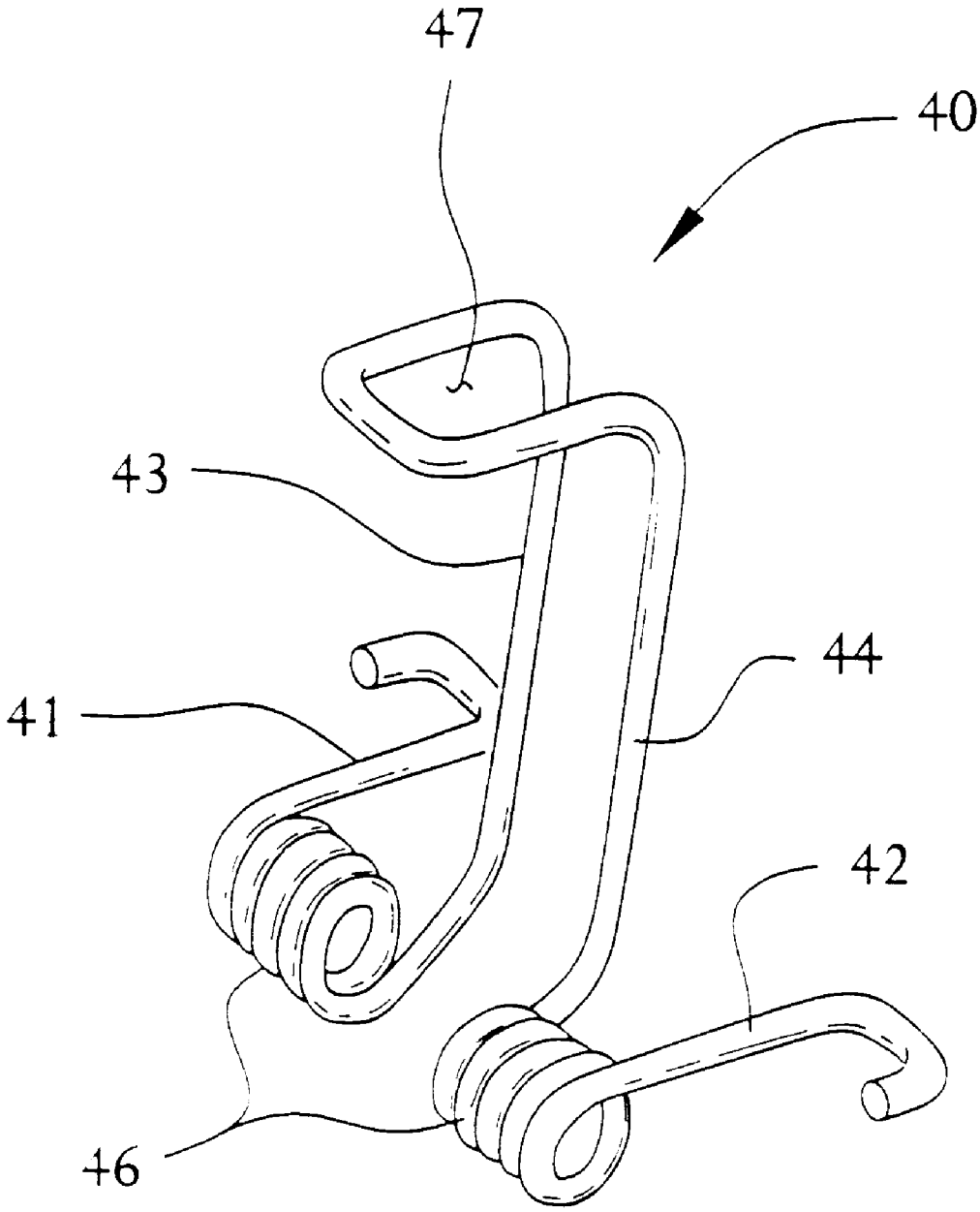

FIG. 9 is a right side perspective view of the pawl torsional spring of the latch assembly of FIG. 1.

Figure 10:
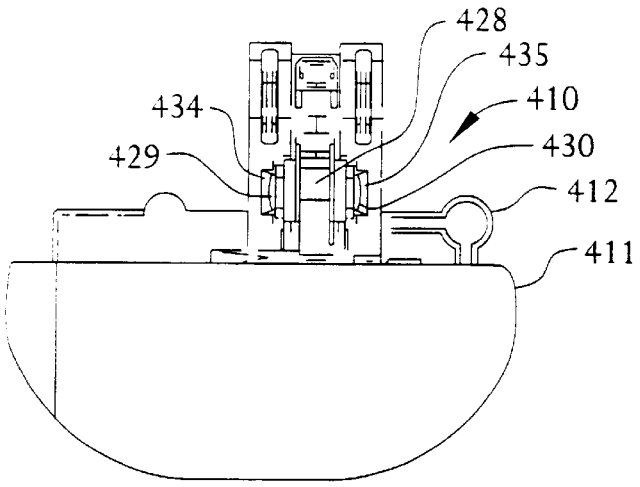

FIG. 10 is a front elevation view of a second alternate embodiment of a latch according to the present invention.

Figure 11:
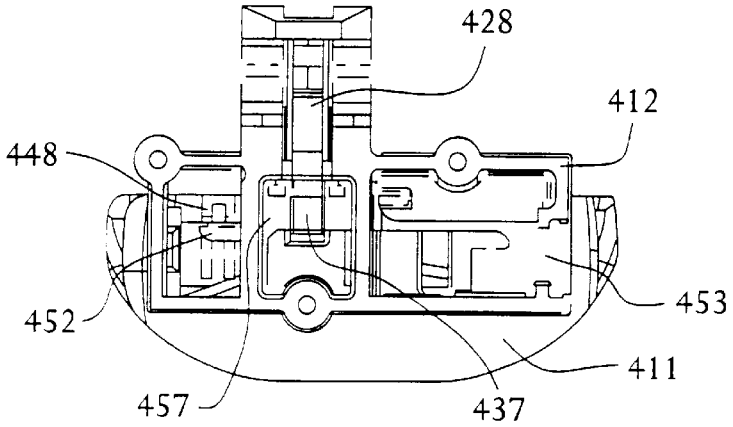

FIG. 11 is a rear elevation view of the latch assembly of FIG. 10.

Figure 12:
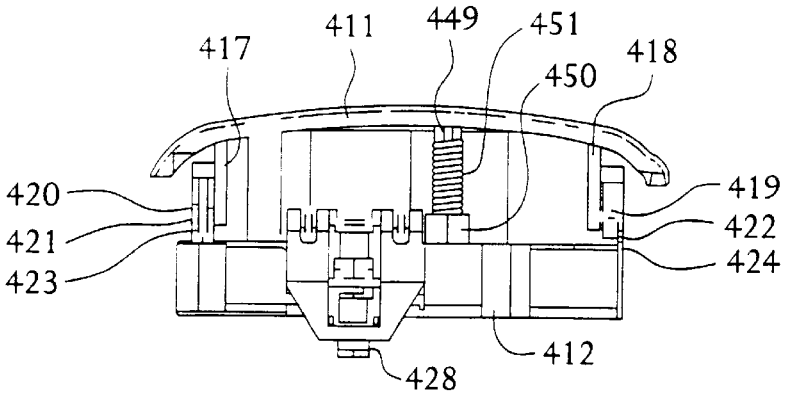

FIG. 12 is a top plan view of the latch assembly shown in FIGS. 10 and 11.

Figure 13:
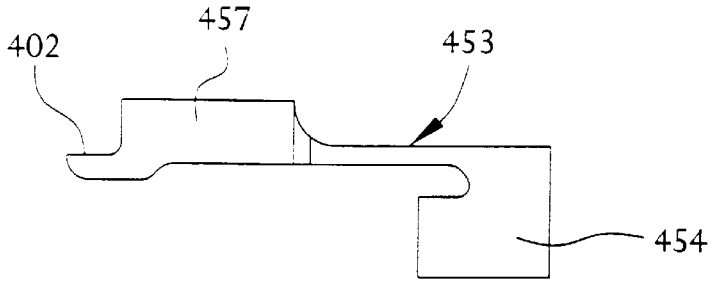

FIG. 13 is a rear elevation view of the locking member of the latch assembly shown in FIGS. 10 through 12.

Figure 14:
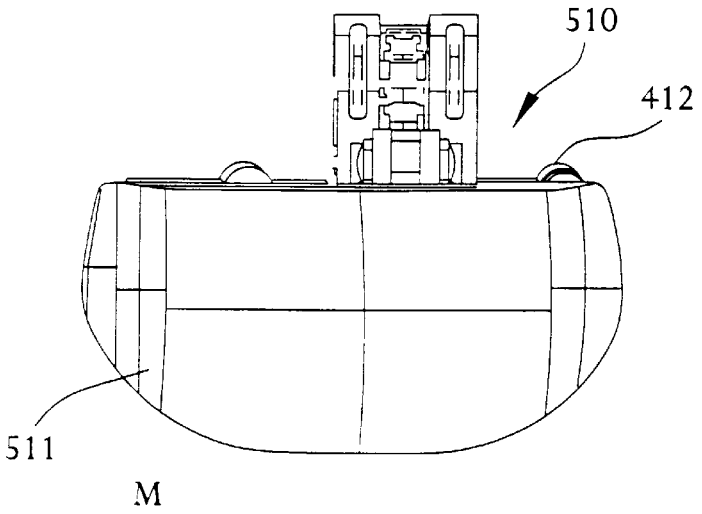

FIG. 14 is a front elevation view of a latch assembly according to FIGS. 10 through 13 shown with an alternate handle embodiment.

Figure 15:
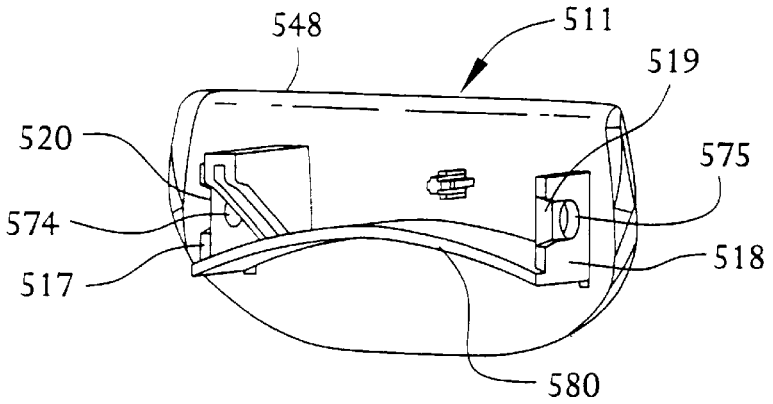

FIG. 15 is a right rear perspective view of the handle of the latch assembly shown in FIG. 14.

Figure 16:
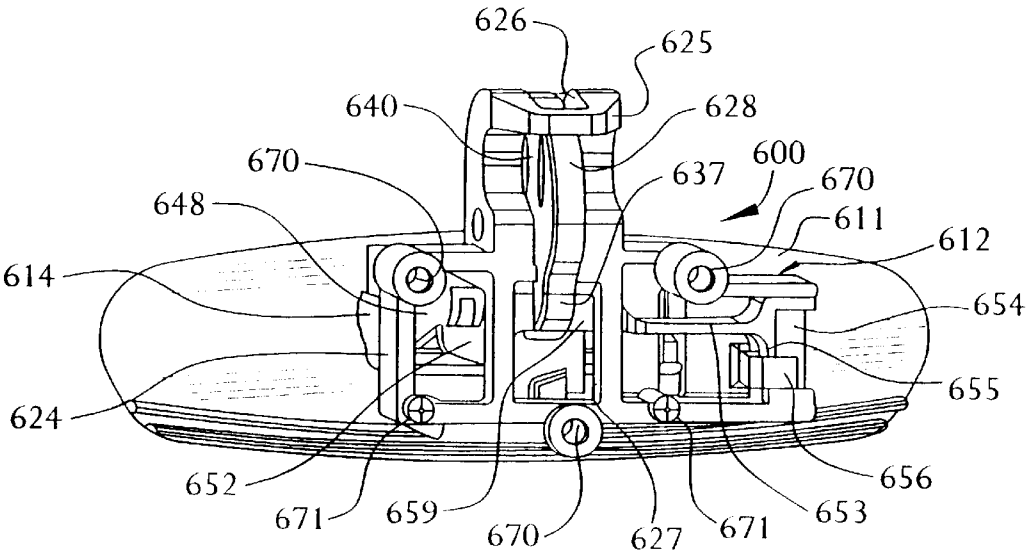

FIG. 16 is a rear perspective view of a third alternate embodiment of a latch assembly according to the present invention, shown in the closed position.

Figure 16A:
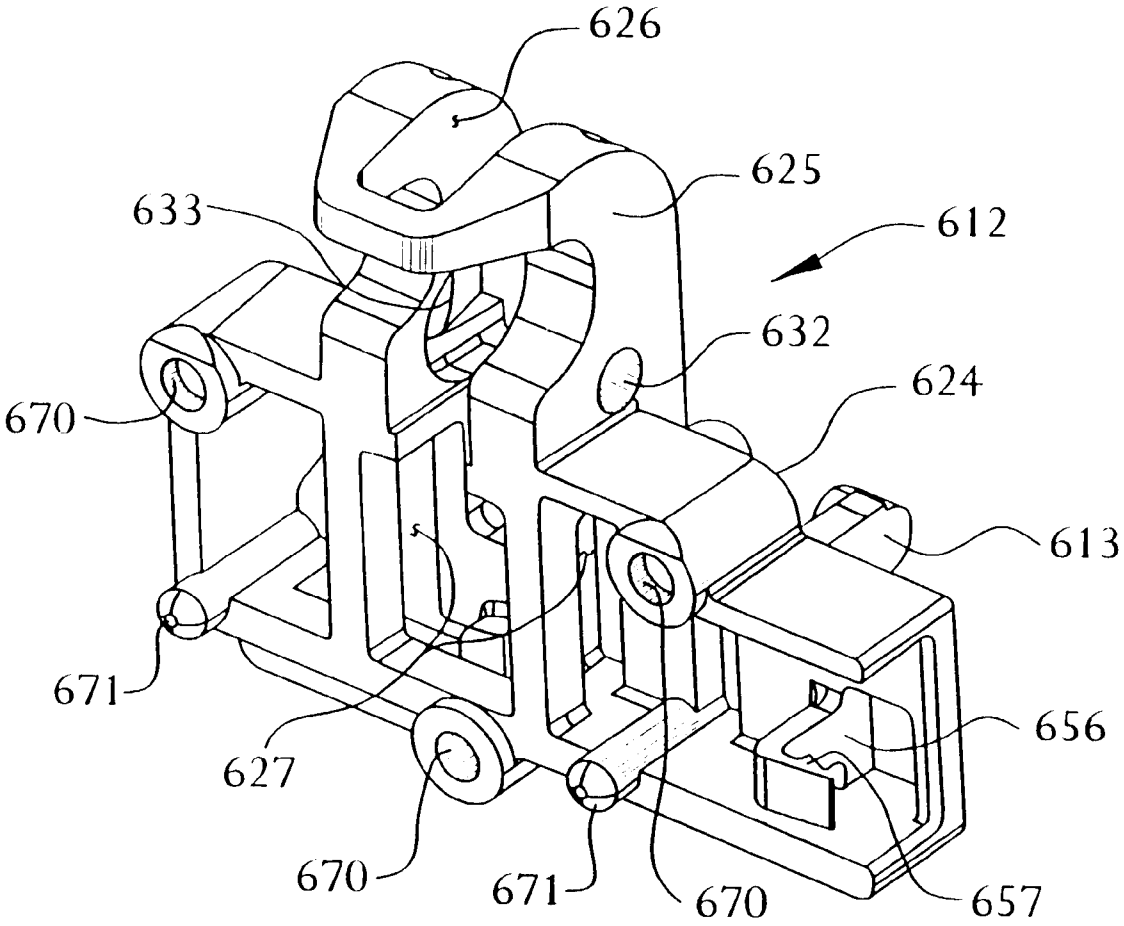

FIG. 16*a* is a rear perspective view of the housing of the latch assembly shown in FIG. 16.

Figure 16B:
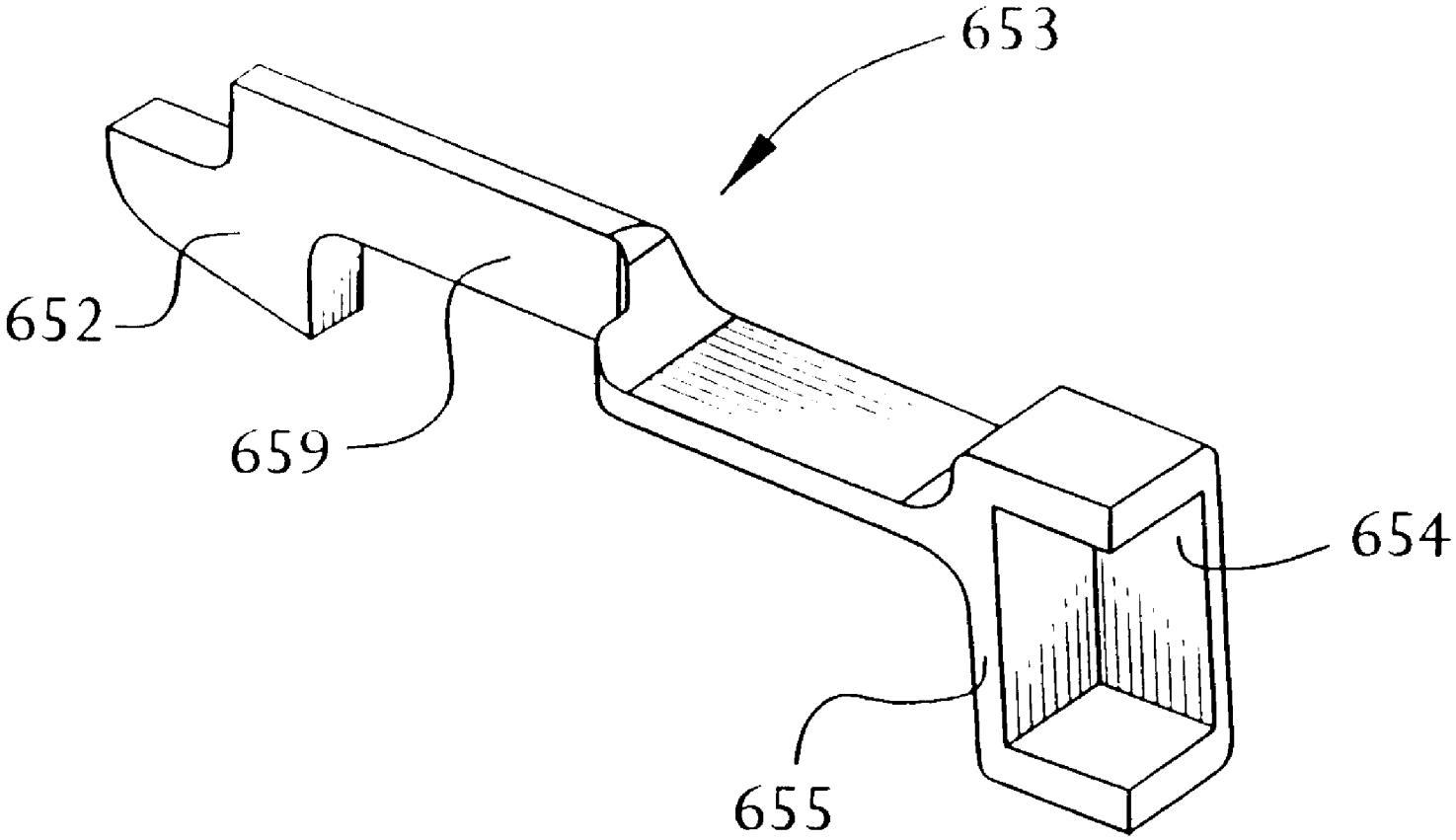

FIG. 16*b* is a rear perspective view of the locking member of the latch assembly shown in FIG. 16.

Figure 17:
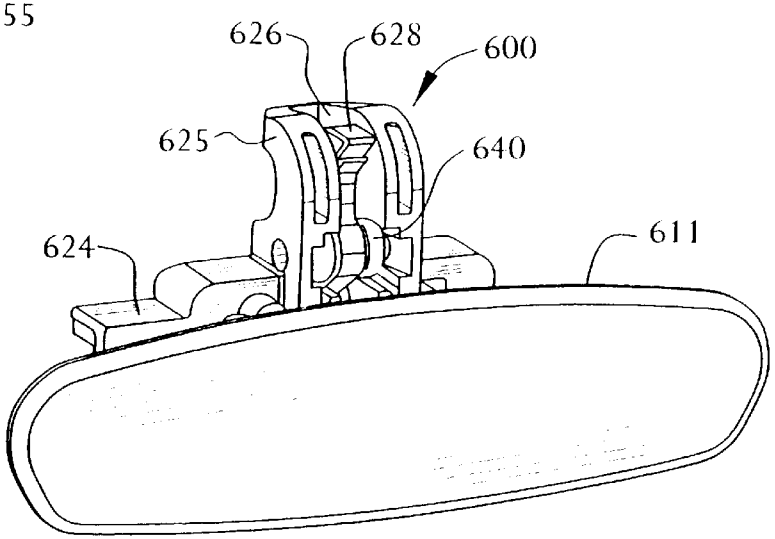

FIG. 17 is a front perspective view of the latch assembly of FIG. 16.

Figure 18:
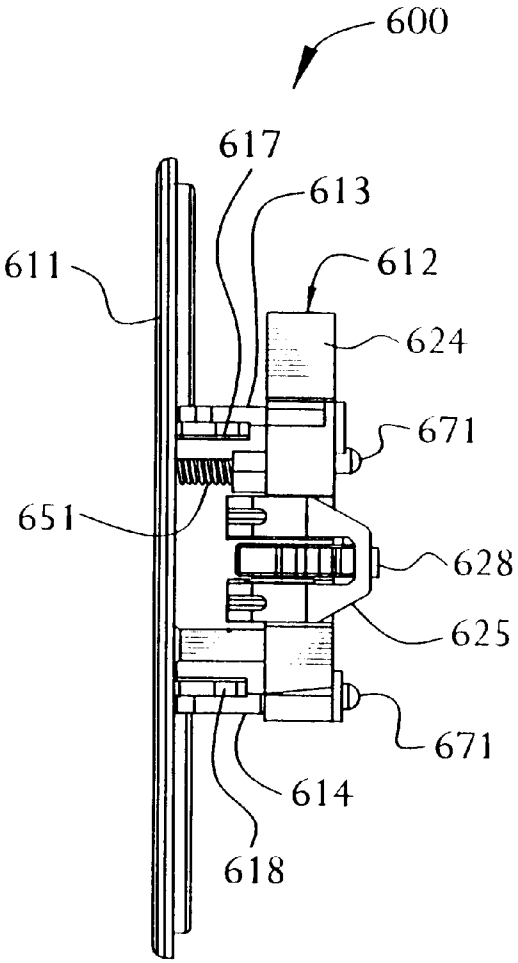

FIG. 18 is a top plan view of the latch assembly of FIG. 16.

Figure 19:
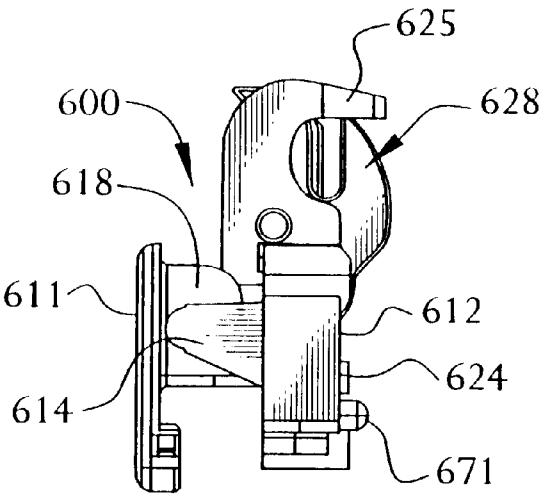

FIG. 19 is a right side view of the latch assembly of FIG. 16.

Figure 20:
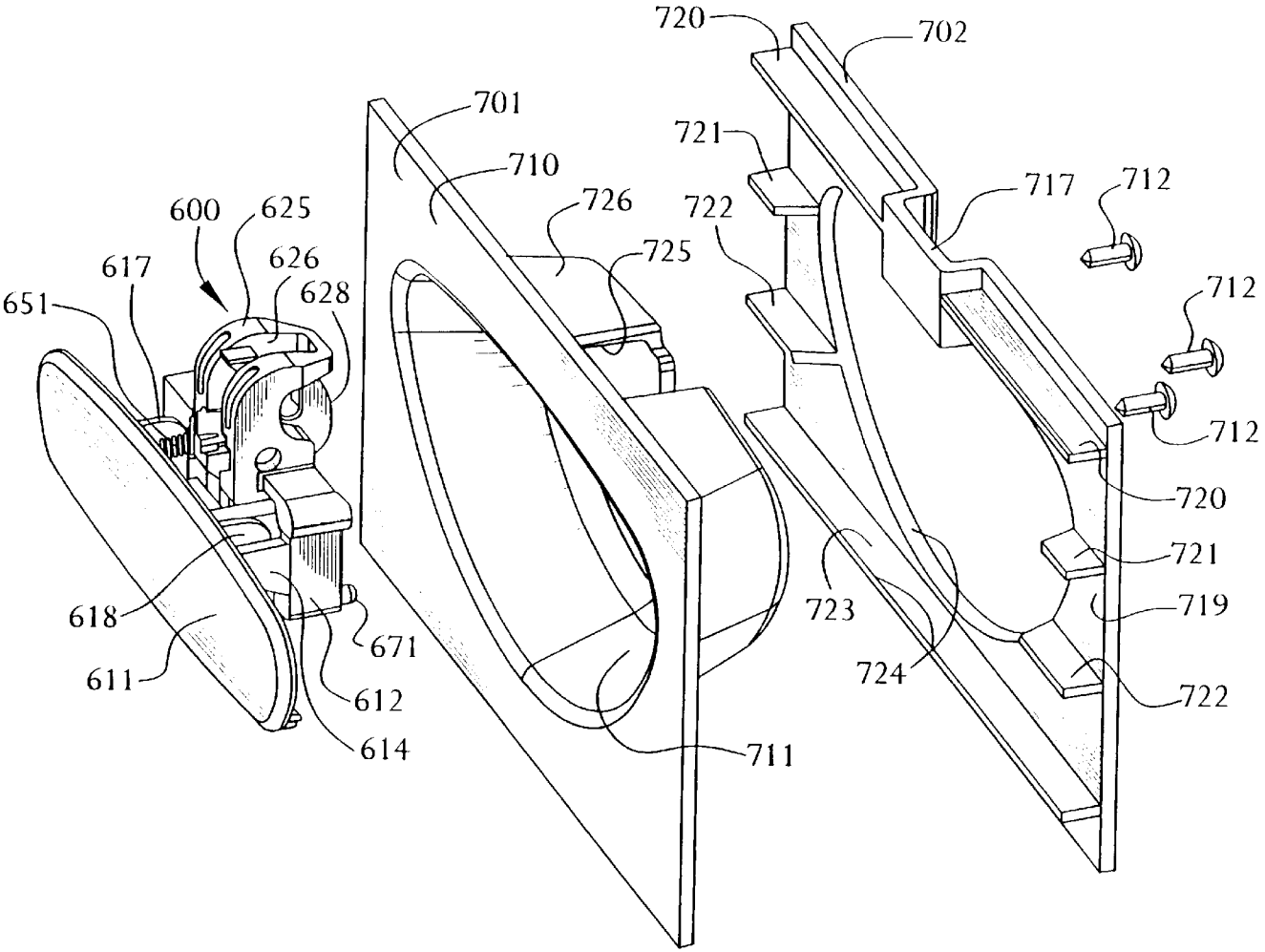

FIG. 20 is an exploded view showing the latch assembly of FIG. 16 with a glove box section and mounting flange.

Figure 21:
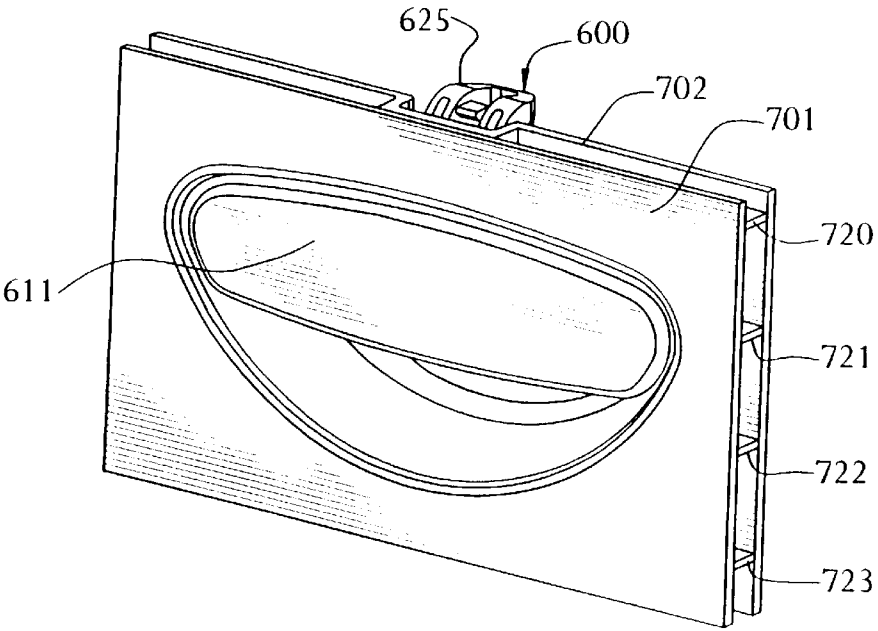

FIG. 21 is an assembled view of the latch assembly, glove box section and mounting flange shown in FIG. 20.

Figure 22:
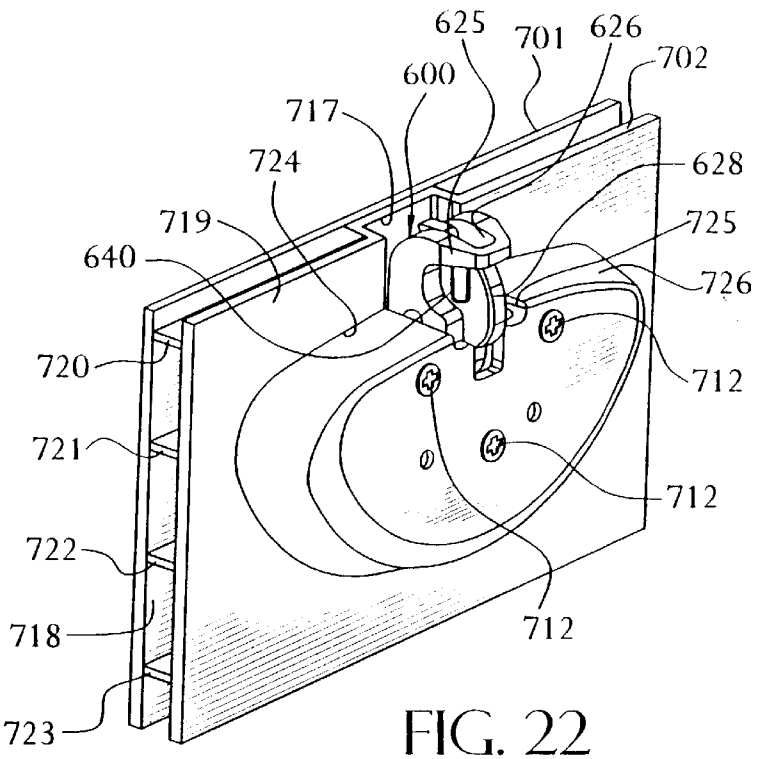

FIG. 22 is a rear perspective view of the latch assembly, glove box section and mounting flange of FIG. 21.

DETAILED DESCRIPTION OF THE PREFERRED EMBODIMENTS

Referring to FIG. 1, a ratcheting pawl latch 10 is shown having an actuating member, such as, for example, the handle or paddle 11 which is pivotally mounted to a latch housing 12. The paddle 11 is attached to the housing in accordance with arrows "a" and snaps into the housing 12. The housing 12 is provided with means for accommodating the handle 11 to allow the handle 11 to rotate over a predetermined range when installed. The handle accommodating means is shown comprising flanges 13 and 14 which have projections thereon, respectively 15 and 16. The paddle or handle 11 is preferably provided with suitable means for attachment to the housing such as pintels, raised bosses or the like. Preferably mounting flanges 17, 18 are provided on opposite handle sides having slots 19, 20 therein respectively (FIG. 5*b*), for attachment to, the projections 15, 16 (FIG. 1) of the housing flanges 13, 14. While a snap-fit handle attachment means is shown in the embodiment of FIG. 1 it is conceivable that other fastening means such as a pins, axles, bearings, and the like can also be employed.

Figure 2:
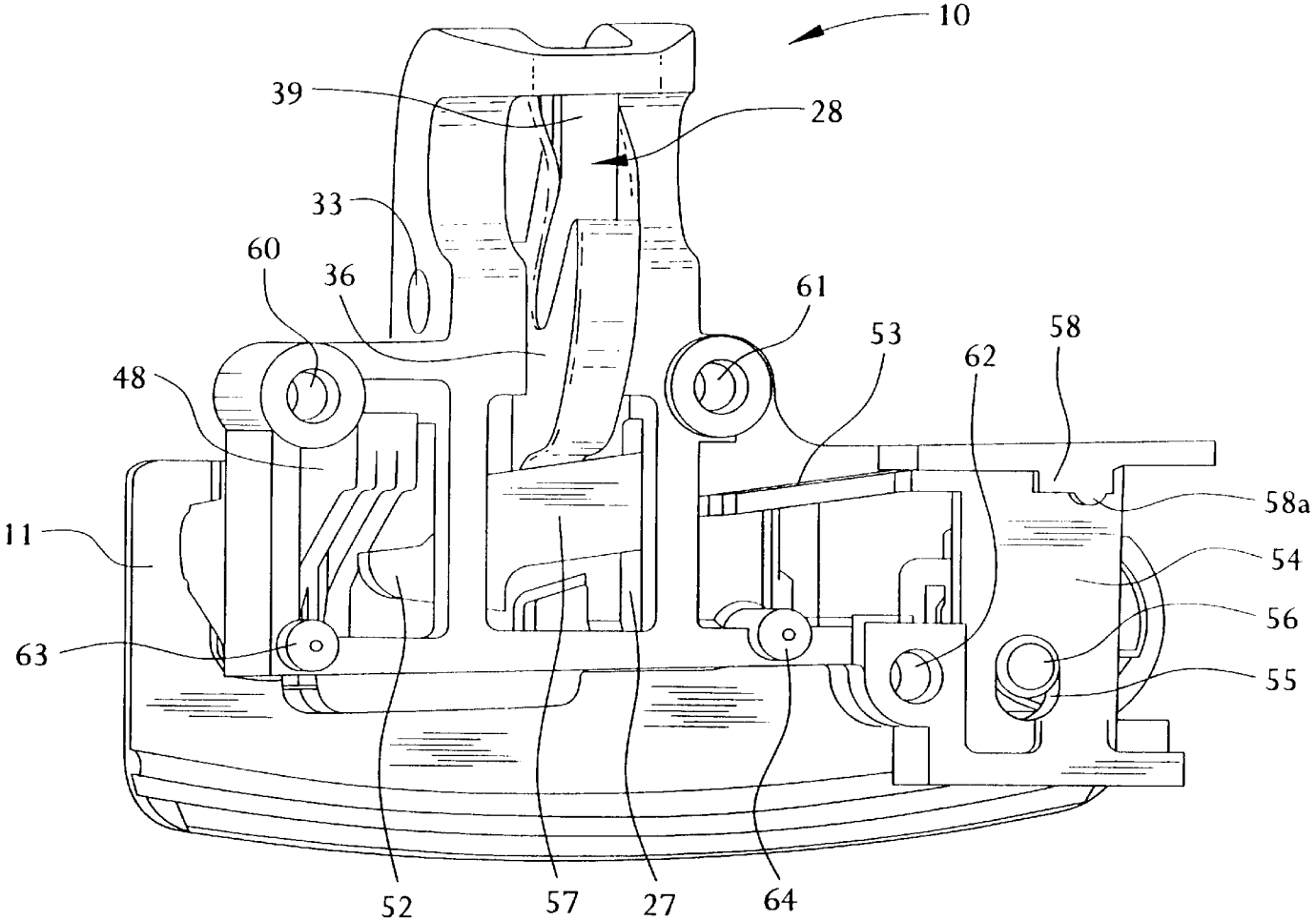
FIG. 2 is a rear perspective view of the latch assembly of FIG. 1 shown in the open position.
Figure 4:
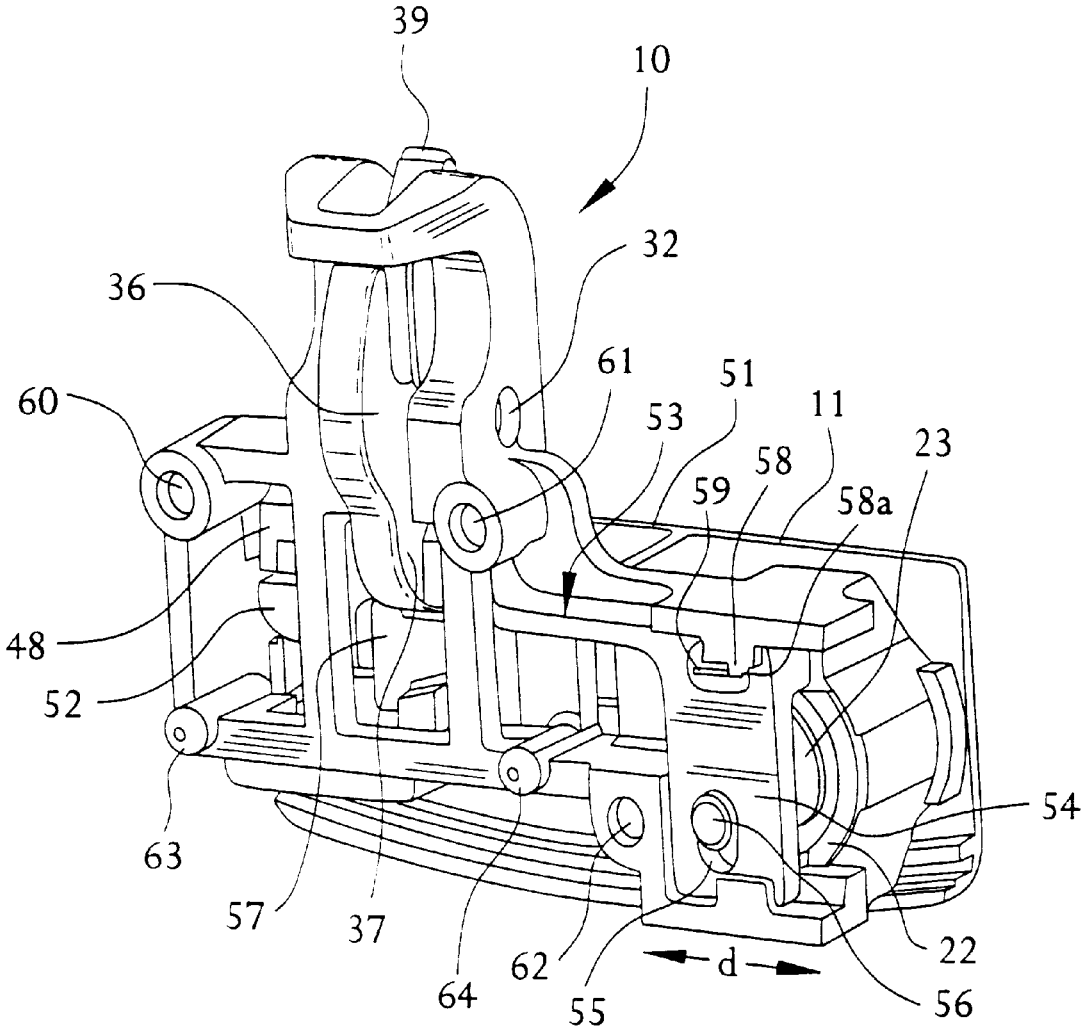
FIG. 4 is a right side rear perspective view of the latch of FIG. 1 shown in the closed position.

The housing 12 is shown in FIG. 1 provided with a lock holding means comprising the lock plug socket 22 having a generally cylindrical bore for receipt of a lock plug 23, which may be optionally provided with the assembly as shown in FIGS. 2, 4 and 7. The housing 12 is provided with a body portion 24 from which the flanges 13 and 14 extend. A flange 25 is provided on the top of the housing body 24. The flange 25 extends rearwardly from the housing body portion 24 and is vertically disposed and terminates into an arm portion which is generally perpendicular to the housing body 24. A first slot 26 is provided within the flange 25 and extends through the rear of the housing body 24 (as shown in the rear view of FIG. 2). The first slot 26 thereby forms a generally L-shaped configuration. A second slot 27 is provided below the vertical component of the first slot 26 and preferably communicates with the first slot 26. The second slot 27 extends through the housing body 24, and is generally perpendicular in relation to the first slot 26, as shown in the rear perspective view of the latch assembly of FIG. 2.

The latch assembly 10 also includes a pawl 28 shown pivotally connected to the latch housing 12 with suitable attachment means such as the pawl pivot members 29,30 which are provided extending outwardly from the pawl 28 at opposite sides thereof. The pivot members 29, 30 can also be provided as a single pivot member extending through the pawl 28. A pair of annular portions 31 are provided on the pawl pivot members 29,30. The annular portions 31 may be provided integral with the pawl pivot members 29,30 or can be separately provided in the form of rings or washer members which can be provided on the pawl pivot member 29,30. The annular portions 31 facilitate centering of the pawl 28 within the housing 12 in the centering slots 45*a*,45*b* provided in the housing 12 (FIG. 1). The pawl 28 is installed onto the housing 12 by snap-fit placement of the pawl pivot members 29,30 into the pawl pivot recesses 32,33 disposed in the housing 12. A pair of guide slots 34,35 is provided on the housing leading from the edge of the housing to the pawl pivot recesses 32,33 for guiding the pawl pivot members 29,30, in the direction of arrow "b" into the pawl pivot recesses 32,33.

As shown in FIG. 1, the pawl 28 is provided having a body portion 36 with a pair of pawl pivot members 29,30 extending therefrom. The pawl 28 has a locking engagement portion 37 and is provided with a pawl slot 38 to retain the keeper member 100 shown in FIG. 3. Preferably the keeper member 100 is attached to the stationary panel or compartment (not shown) at a position such that when the swinging panel to which the latch assembly 10 is attached is rotated to engage the keeper member 100, the keeper member 100 will be below the arm portion of the upper flange 25 for engagement with the pawl 28. The pawl 28 is also shown having an arm portion 39 extending from the pawl body 36. A pawl torsional spring 40 is shown installed on the pawl 28, and having downwardly extending tail portions 41,42 and arms 43,44 extending vertically therefrom. The vertical spring arms 43,44 extend from the respective coil portions 46 of the torsional spring 40 and connect to form a slot 47 for receiving the pawl arm 39 therein for engagement therewith.

The paddle 11 in FIG. 1 is shown having an actuation arm 48 extending rearwardly therefrom and a paddle retaining pin 49 extending rearwardly therefrom. Extending from the housing body 24 is a spring retaining socket 50 which is disposed in the area of the paddle retaining pin 49. A paddle compression spring 51 is installed on the retaining pin 49 and is held in part by the socket 50, as shown by arrow "c." The spring 51 provides a bias when the handle 11 is lifted so that after actuation takes place the handle 11 is returned to its original position by the force of the compression spring 51.

As shown in FIG. 2, the actuation arm 48 of the paddle 11 is provided to engage the engaging end 52 of the spring locking member 53 (FIG. 1). The spring locking member 53 is provided to extend through the lateral second slot 27 disposed in the lower portion of the housing 12. At the opposite end of the paddle engaging end 52 of the spring locking member 53 is the retaining portion 54 which is shown having a slot 55 provided therein for accommodating a locking pin 56 of a lock plug 23 which is disposed within the lock socket 22. The spring locking member 53 is preferably comprised of a spring steel composition or plastic composition such as for example acetal, or any suitable like flexible member which is also durable enough to withstand the forces of actuation of the latch assembly.

In addition, the retaining portion 54 of the locking member 53 is provided with a positioning tab 59 which engages a positioning stop 58 on the housing 12. This facilitates alignment of the locking pin 56 within the slot 55, by maintaining the locking member 53 in a desired position (see FIG. 4).

The positioning stop 58 is shown comprising a detent 58*a* which extends downward in relation to the positioning tab 59. The positioning tab 59 is preferably provided as a spring member for deflection by the positioning stop 58 as the locking member 53 is slidably moved in parallel relation in the horizontal direction shown by the path of double arrow "d", from one side to the other of the positioning stop 58. This is accomplished by the selective engagement of the lock plug pin 56 by the user with a key or other operating device. As shown in FIG. 4, the latch 10 is in the unlocked position with the paddle engaging portion 52 of the locking member 53 seen positioned below the actuation arm 48 or the paddle 11 for selective engagement therewith when the paddle 11 is drawn forward. Referring to FIG. 4, in order to lock the assembly, the lock pin 56 is rotated to slide the locking member 53 to the right in the direction of arrow "d" to draw the paddle engaging portion 52 of the locking member 53 out of the reach of the paddle actuation arm 48. In the locked position, while not shown, the positioning tab 59 will be caused to be moved to the right of the positioning stop 58 by the movement of the lock pin 56 and will thus prevent the paddle engaging portion 52 of the locking member 53 from being able to engage the paddle actuation arm 48 when the paddle 11 is lifted.

Figure 3:
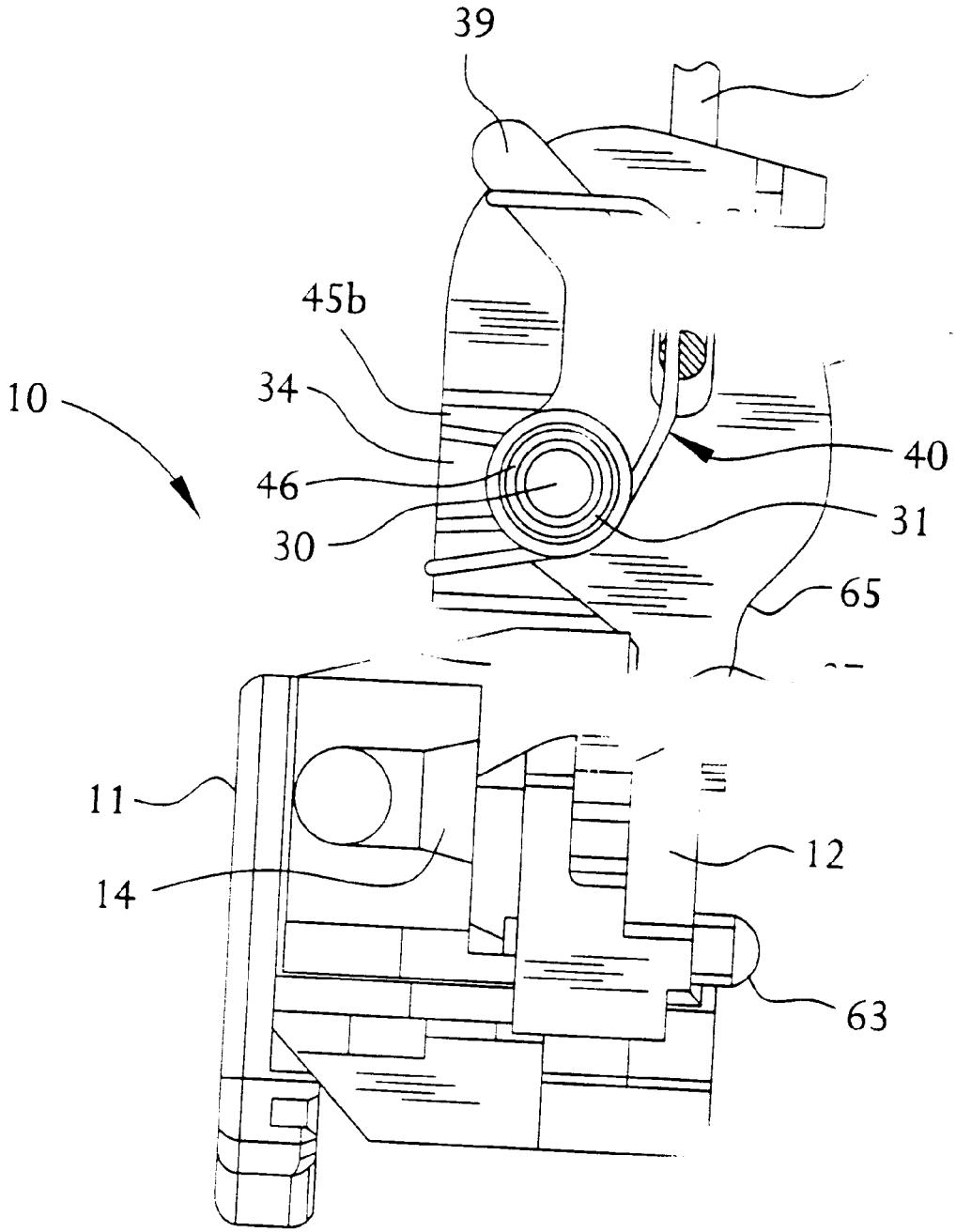
FIG. 3 is a left side elevation view of the latch assembly of FIG. 1.

The spring locking member 53 is also provided with a pawl engaging portion 57 which engages the locking arm 37 of the pawl 28. The latch assembly 10 is actuated by lifting the paddle 11 in an upward direction (away from the surface to which the latch assembly 10 is mounted). The actuation arm 48 of the paddle 11 engages the paddle engaging portion 52 of the locking member 53 (FIG. 2) and the engaging portion 52 is lowered within the lateral second slot 27 of the housing 12. By actuating the locking member 53, it is lowered a distance such that the pawl engaging portion 57 of the locking member 53, which engages the pawl locking arm 37, is moved out of engagement with the pawl locking arm 37 thereby freeing up the pawl 28 for pivoting. The bias provided by the pawl torsional spring 40 releases the pawl 28 from its vertical (FIG. 1 and FIG. 3) position and allows the pawl 28 to rotate to disengage the keeper member 100, thereby opening the compartment or panel to which the latch assembly 10 is attached. The keeper member 100 is shown in FIG. 3 comprising a striker wire, but may comprise any like suitable member such as a bar, claw, or other suitable attachment member.

A notched portion 65 is shown in the back of the pawl 36 to provide clearance for the locking member 53, when the pawl 36 is released, as shown in FIG. 2. This facilitates the relief of stress upon the spring locking member 53 when the pawl is in its released (FIG. 2) position.

Referring again to FIG. 2, interference means for facilitating the maintenance of the latch 10 in its locked position is shown. The interference means is shown comprising a stop element 68 protruding upwardly from the bottom of the housing 12. The stop element 68 is provided to engage with the lower edge 69 of the locking member foot 52 when the locking member 53 has been slid to the right, in the rightward direction represented by double arrow "d" shown in FIG. 4. The locking member 53 can be translated to the right by eccentric rotation of the lock pin 56. With the locking member 53 withdrawn to the right, and clearing the actuation arm 48 of the paddle 11, the latch 10 remains locked, and the lower edge 69 of the locking member foot 52 is positioned above, or in engagement with, the stop element 68. With the locking member foot 52 aligned with the stop element 68, the locking member 53 is prevented from being lowered to clear the pawl tail 37, and the pawl 28 thereby remains in its latched or engaged position relative to the keeper.

Suitable mounting means are provided to retain the latch assembly 10 on a panel or mounting surface. For example, installation of the latch assembly 10 to a panel may be accomplished with the mounting means shown in FIG. 2 comprising apertures 60,61,62 and guide pins 63,64 for facilitating the fastening of the latch assembly to a panel, such as for example, a glove box of an automobile.

An alternate embodiment of a latch assembly according to the present invention may be provided wherein the lock plug 21 (FIG. 1) is not employed. In such an embodiment, the handle utilized can be supplied without the lock aperture 70 of FIGS. 5*a*, 5*b*.

FIGS. 5*a* and 5*b* show the handle 11 of the present latch assembly 10 installed on a panel 300. The handle 11, is shown provided with a lock aperture 70 for allowing access to and exposing the lock plug 23 installed on the housing 12. The paddle boss 49 is provided to retain the paddle spring 51 (FIGS. 1 and 4) between the handle 11 and the spring-retaining socket 50 of the housing 12. The paddle flanges 17,18 and slots 19,20 permit attachment to the housing 12 as previously described above. As shown in FIG. 5*b*, apertures 74,75 are disposed in the flanges 17,18 at the end of the slots 19,20 for retention of the housing projections 15,16 (FIG. 1).

The handle 11 of the latch assembly 10 may optionally be provided having multiple-piece construction, as shown in FIGS. 6*a* and 6*b*, wherein the handle 311 is provided to extend over a portion of the housing 12, but not over the lock plug 23. In this embodiment, a trim plate 319 is provided to cover the area surrounding the lock plug 23. The trim plate 319 is shown having an aperture therein 370 for permitting access to the lock plug 23. The trim plate 319 is also provided with suitable mounting means for attachment to the housing 12. The mounting means are shown in FIG. 6*b* comprising a plurality of flange members 323 extending outwardly from the trim plate 319. While not shown, the trim plate can alternately be attached to the panel on which the latch is to be mounted with any suitable attachment means. In addition, the trim plate may be provided of varied sizes and dimensions including even a portion which underlies the bottom of the handle 311 to form a face plate.

FIG. 6*b* also, shows the means for connecting the paddle 311 to the housing 12. The paddle 311 comprises outwardly extending flange members 371,372 having slotted portions 376,377 therein which facilitate guiding the paddle over the housing projections 15,16 for installation of the projections 15,16 into the apertures 374,375 provided in the flange members respectively, 372,371 of the paddle 311. Preferably, a connecting portion 373 is also provided for stability and retention, and is shown connecting the paddle flanges 371,372. The paddle 311 further includes an actuation arm 348 and a spring holding boss 349, for operation similar to that described above in relation with the paddle 11 of FIGS. 1, 2, 4, 5*a* and 5*b*.

Referring to FIG. 7, a first alternate embodiment of a latch assembly 210 according to the present invention is shown having an offset actuating mechanism. The actuating member 211 is provided at a distance from the housing body 212 and is shown having an extension member 209 which is connected to the paddle 211 for rotation with the paddle 211. A paddle mounting plate 213 is also provided to pivotally support the paddle 211. The extension member 209 extends from the paddle 211 to the housing and has an actuation arm 247 for selectively engaging the engaging portion 252 of the locking member 253 to lower the locking member 253 out of engagement with the locking arm of the pawl 226.

A lock socket 220 is provided with a lock cylinder 257 installed therein. The lock cylinder 257 is provided with a locking pin member 256 which selectively engages a loop 206 of a wire member 207 which is connected to the locking portion 254 of the locking member 253 to control movement thereof. While not shown, the wire member 207 may alternately be configured to actuate the locking member 253 as well.

Referring to FIG. 10, a second alternate embodiment of a latch assembly 410 is shown according to the present invention. A paddle 411 is provided and is pivotally connected to a housing 412. A pawl 428 is pivotally installed in the housing through a pair of guide slots 434, 435 through which pawl pivot members 429, 430 are received, in the same manner as described above in connection with the embodiments shown in FIGS. 1 through 9. The pawl 428 can be provided in the same manner as the pawl 28 shown in FIGS. 1 through 4 and 8 and 9 above, and is installed and operates within the housing in the manner described above.

FIG. 11 is a rear view of the latch of FIG. 10 showing a spring locking member 453 installed within the housing 412. The locking member 453 is shown in FIG. 13 in an enlarged view. The engaging end or foot 452 of the locking member 453 is provided to be engaged by the paddle arm 448 (FIG. 11) when the latch 410 is actuated. The spring locking member 453 also includes a pawl engaging portion 457 which engages the locking arm 437 of the pawl 428. A retaining portion 454 is provided at one end of the locking member 453 and is held within the housing 412, as shown in FIG. 11. The pawl 428 and locking member 453 function in the manner described above in the embodiments shown in FIGS. 1 through 9. When the latch 410 is actuated by lifting the handle 411 away from the housing the actuation arm 448 of the handle 411 depresses the engaging portion 452 of the locking member 453 The spring locking member 453 is thereby deflected by the actuation of the paddle 411 and the pawl 428 is then released from engagement with a keeper member, as discussed above.

Referring to FIG. 12, a compression spring 451 is shown disposed between the housing 412 and the paddle 411. The paddle compression spring 451 is held by a retaining pin 449 extending outwardly from the inside of the paddle 411. The opposite end of the compression spring 451 may be held in a socket 450 of the housing as described above in connection with the embodiment of FIGS. 1 through 9. FIG. 12 shows the handle 411 being held on the housing 412 by a pair of mounting flanges 417, 418 extending outwardly from the handle on opposite ends thereof, each flange having a guide slot 419, 420, respectively, in which are disposed apertures, respectively, 421 and 422. The housing is provided with a pair of outwardly extending arms, 423, 424 which include projections, as described above and shown in connection with FIGS. 1–9, which are received in the handle flange apertures 421, 422. The handle 411 is thereby pivotally connected to the housing 412.

A third alternate embodiment of a latch assembly according to the present invention is shown in FIG. 14. The latch 510 is provided similar to that 410 described above and shown in FIGS. 10 through 13 but with the paddle 511 having a larger dimension. The latch embodiment 510 permits push and pull actuation of the latch assembly. The handle 511 can be pulled by gripping below the paddle and pulling it forward, or, alternately, can be actuated by depressing the upper portion of the paddle inwardly toward the housing 412.

FIG. 15 is a rear view of the paddle 511 of the latch embodiment 510 shown in FIG. 14. The paddle 511 includes paddle flanges 517, 518 and slots 519, 520 which permit attachment to a housing, such as that 412 described above and shown in FIGS. 10 through 13. The paddle flanges 517, 518 also contain apertures 574, 575, respectively, disposed therein. A grip guard 580 is provided to prevent slippage of a user's fingers into the latch assembly when the latch is operated. The handle 511 also includes an actuation arm 548 which is provided to engage a locking member as described above in accordance with the latching and unlatching operation.

Referring to FIGS. 16 through 22, a fourth alternate embodiment of a latch 600 according to the present invention is shown, having a handle 611 which is pivotally mounted to a latch housing 612. The handle 612 has flanges 617, 618, which connect with corresponding flanges 613, 614 of the housing 612. The handle 611, for example, can be connected to the housing 612 in the same manner as that described in connection with the latch embodiment 10 shown and discussed in relation to FIG. 1 above. Referring to FIG. 16a, the housing 612 is shown having a body portion 624. A flange 625 extends rearwardly from the housing body portion 624 and is vertically disposed, terminating into an arm portion which is generally perpendicular to the housing body 624. A first slot 626 is provided within the flange 625 and extends through the rear of the housing body 624, the first slot 626 thereby forming a generally L-shaped configuration, similar to that first slot 26 shown and described in connection with the housing 12 of the latch of FIG. 1. A second slot 627 is provided below the vertical component of the first slot 626 and preferably communicates with the first slot 626. The second slot 627 extends through the housing body 624 and is generally perpendicular in relation to the first slot 626. Pawl pivot recesses 632, 633 are provided to receive the pins of a pawl member, such as that 28 or 628, to retain a pawl on the housing 612.

Referring again to FIG. 16, a pawl 628 is shown mounted on the housing 612. The pawl 628, as shown in FIG. 17, can comprise a pawl similar to that 28 shown in connection with the latch embodiment described in FIGS. 1 through 9 above, and includes a torsion spring 640, which is mounted with the pawl 628 in the same manner described above in connection with the latch embodiments shown and described in FIGS. 1 through 15. The locking member 653 is provided to extend through the lateral second slot 627 disposed in the lower portion of the housing 612.

As shown best in FIG. 16*b*, the locking member 653 includes a foot 652 at one end thereof and a retaining portion 654 at the opposite end thereof. The retaining portion 654 has connecting means for connecting the locking member 653 to the housing 612. Preferably, the connecting means comprises a connecting wall 655 onto which corresponding housing connecting means can secure. Preferably, the housing connecting means comprises a snap leg 656, which engages the connecting wall 655 of the locking member 653 and secures the locking member 653 into position within the latch assembly 600.

As shown in FIG. 16*a*, the snap leg 656 extends from the housing body 624 and has a retaining barb 657 disposed at the end thereof for engagement with the connecting wall 655 of the locking member 653. Preferably, the snap leg 656 is comprised of a material which facilitates spring action to snap over the connecting wall 655 and secure the locking member 653 to the housing 612.

The latch 600 is actuated by lifting the handle 611 to thereby lower the handle actuation arm 648 to depress the locking member 653. When this occurs, the pawl engaging portion 659 of the locking member 653 is lowered out of the way of the pawl tail 637. This permits the pawl 628 to disengage from the keeper, since, with the locking member 653 moved out of the engaging position with the pawl tail 637, the torsion spring 640 can then operate to bias the pawl 628 rearwardly to an open or unlatched position.

Mounting means for mounting the latch to compartment surface or mounting flange are provided. As shown in FIG. 16, the mounting means can comprise a series of bores 670 and can further include locating bosses 671, which can be used to position the latch 600 or to stabilize the latch 600 during mounting and when the latch is installed.

Referring to FIG. 18, a compression spring 651 is shown disposed between the handle 611 and housing 612, and preferably may be installed in the same manner as the compression spring 51 shown in connection with the latch embodiment of FIGS. 1 through 9.

Reference now being made to FIGS. 20, 21 and 22, the latch 600 of the present invention is shown in a glove box installation. FIG. 20 shows the latch 600 with a glove box section 701 and a mounting flange 702. The glove box section 701 can comprise a portion of a glove box panel or can be separately provided to be installed on a cutout of a glove box. Although a glove box panel is referred to, it will be understood that other panel applications, such as doors, cabinets and the like, can also be utilized consistent with the latch 600 of the present invention. The panel section 701 is shown comprising a panel surface 710 with a recessed portion 711 disposed therein for accommodating the latch 600. Mounting means, such as, for example, screws 712, can be used to secure the latch 600 to the panel section 701. For example, the screws 712 may comprise threads (not shown) which can be received in matingly threaded bores 670 of the latch housing 612. As shown in FIG. 22, the mounting flange 702 includes a plurality of supporting elements 720, 721, 722, 723, which extend rearwardly from the mounting flange surface 719 for engagement with the rear surface 718 of the glove box panel 701. The mounting flange 702 includes an indented portion 717, which accommodates the flange portion 625 of the housing 612 when assembled, as shown best in FIG. 22. A cutout or aperture 724 is provided in the mounting flange 702 to accommodate the recessed portion 711 of the panel section 701 when the latch 600, glove box panel 701 and mounting flange 702 are assembled. As shown best in FIGS. 20 and 22, the glove box panel recessed portion 711 includes a cutout 725 in the top portion 726 thereof for accommodating the pawl and housing flange components of the latch 600.

It will be further understood that while the latch 600 is shown in connection with an installation in a glove box panel 701 with a mounting flange 702, various alternate installations of the latch 600 can be accomplished consistent with the invention as shown and described herein. For example, the latch may be installed directly on a panel, can be enclosed in a secondary housing which can then be attached to a panel, or other suitable alternate mountings of the latch assembly 600 can be made. In addition, while the latch 600 is shown with a lift-up type handle 611, it will be understood that the push-in type handle shown and described in connection with the alternate handle embodiment of FIGS. 14 and 15, can also be utilized.

It will be apparent to those skilled in the art that various modifications can be made to the ratcheting pawl latch invention without departing from the scope and spirit of the invention, and it is intended that the present invention cover modifications and variations of the ratcheting pawl latch which are within the scope of the appended claims and their equivalents.

What is claimed is:

1. A latch assembly for securing a first panel to a second panel wherein said panels are movable in relation to each other and wherein at least one of said panels has a keeper member installed thereon, said latch assembly comprising:

a) a pawl;

b) a spring locking member;

c) an actuating member;

d) housing means for housing said pawl, said locking member and said actuating member in cooperating relation with each other for selective engagement and release of said latch assembly with said keeper member;

e) locking means for locking said locking member against engagement by the actuation member; and f) interference means for retaining said spring locking member in a position to prevent releasing of the latch when the latch is locked.

2. The latch assembly of claim 1, wherein said interference means comprises a stop disposed on said housing means and adapted to engage said locking member when said locking member is in a locked position.

3. The latch assembly of claim 1, wherein said locking means comprises means for moving said locking member to a position relative to said actuation member, wherein said locking member is not engaged by said actuation member, and wherein said position wherein said locking member is not engaged by said actuation member is a position wherein said interference means stops said locking member from movement out of engagement with said pawl member.

4. The latch assembly of claim 1, further comprising a pawl spring carried on said pawl for biasing said pawl to retract from engagement with the keeper member when the locking member disengages the pawl.

5. The latch assembly of claim 4, wherein said pawl includes pivot means for rotatably mounting said pawl to said housing.

6. The latch assembly of claim 5, further comprising means for mounting said latch assembly to a panel.

7. The latch assembly of claim 1, wherein the actuating member comprises a member pivotally connected to said housing means and being pivotable by lifting or pressing said actuating member.

8. The latch assembly of claim 7, wherein said locking member comprises a spring steel member.

9. The latch assembly of claim 1, wherein said locking member is provided with an engaging portion at one end thereof and a locking portion at the other end thereof, said locking portion including a slot disposed therein.

10. The latch assembly of claim 1, wherein said locking member is provided with an engaging portion at one end thereof and a connecting portion at the other end thereof, said connecting portion being adapted to connect to said housing means to retain the locking member thereon.

11. The latch assembly of claim 10, wherein said housing means further comprises retaining means for retaining the connecting portion of said locking member thereto.

12. The latch assembly of claim 11, wherein said housing retaining means comprises a snap leg member, and wherein said locking member has a matingly associated leg member.

13. The latch assembly of claim 1, wherein said locking means comprises a socket provided in said housing means, and a lock cylinder which is installed in said socket, said lock cylinder having a pin member which is selectively retractable for selective engagement with the slot of the locking portion of said locking member.

14. The latch assembly of claim 9, wherein said locking means comprises a socket provided in said housing means, and a lock cylinder which is installed in said socket, said lock cylinder having a pin member which is disposed for positioning within the slot of the locking portion of said locking member and which is eccentrically moveable for translating the locking member between a first position wherein the locking member can be engaged by said actuation member in a manner which releases the pawl from a latched position, and a second position wherein the actuation member does not engage the locking member in a manner which releases the pawl from a locked position.

15. The latch assembly of claim 1, further comprising a spring member provided between the actuation member and the housing.

16. The latch assembly of claim 1, further comprising stress relief means for relieving stress on said locking member when said pawl is released from said keeper member.

17. The latch assembly of claim 11, wherein said pawl further comprises a recessed portion for accommodating said locking member upon release of the pawl from said keeper member.

18. A latch assembly for securing a first panel to a second panel wherein said panels are movable in relation to each other and wherein at least one of said panels has a keeper member installed thereon, said latch assembly comprising:

a) a pawl;

b) a spring locking member;

c) an actuating member;

d) housing means for housing said pawl, said locking member and said actuating member in cooperating relation with each other for selective engagement and release of said latch assembly with said keeper member; and e) means for retaining said locking member on said housing means.

19. The latch assembly of claim 18 wherein said means for retaining said locking member on said housing means comprises a snap leg disposed on said housing means, and wherein said locking member has at least one engaging portion matingly provided thereon for connection to said housing snap leg.

20. The latch assembly of claim 18, wherein said means for retaining said locking member on said housing means comprises an engaging portion disclosed on said locking member and a retaining element provided on said housing means to engage with the engaging portion of said locking member.

21. The latch assembly of claim 20, further comprising a pawl spring carried on said pawl for biasing said pawl to retract from engagement with the keeper member when the locking member disengages the pawl.

22. The latch assembly of claim 21, wherein said pawl includes pivot means for rotatably mounting said pawl to said housing means.

23. The latch assembly of claim 22, further comprising means for mounting said latch assembly to one of said first and second panels.

24. The latch assembly of claim 23, wherein the actuating member comprises a member pivotally connected to said housing means and being pivotable by lifting or pressing said actuating member.

25. The latch assembly of claim 24, wherein said locking member comprises a spring steel member.

26. The latch assembly of claim 18, wherein said spring locking member further comprises connecting means for connecting with the means for retaining said locking member on said housing means.

27. The latch assembly of claim 26, wherein said means for retaining said locking member on said housing means comprises a snap leg member, and wherein said locking member has an engaging foot at one end thereof and a wall member at the opposite end thereof which engages with said snap leg member to retain the locking member on the housing.

28. The latch assembly of claim 18, further comprising a spring member provided between the actuation member and the housing.

29. The latch assembly of claim 18, further comprising stress relief means for relieving stress on said locking member when said pawl is released from said keeper member.

30. The latch assembly of claim 18, wherein said pawl further comprises a recessed portion for accommodating said locking member upon release of the pawl from said keeper member.

31. The latch assembly of claim 23, wherein said mounting means comprises a cut out portion disposed in one of said first and second panels.

32. The latch assembly of claim 31, wherein said mounting means comprises a recessed portion provided in one of said first and second panels for accommodating said latch assembly therein, said recessed portion having a cut out therein for facilitating access to said keeper by said pawl.

33. The latch assembly of claim 32, wherein said mounting means further comprises a mounting flange for facilitating mounting of said latch assembly onto a panel.

34. The latch assembly of claim 33, wherein said mounting flange has an aperture configured to accommodate said recessed portion and a plurality of support elements for supporting said mounting flange on one of said first and second panels.

35. The latch assembly of claim 1, wherein said mounting means comprises a cut out portion disposed in one of said first and second panels.

36. The latch assembly of claim 35, wherein said mounting means comprises a recessed portion provided in one of said first and second panels for accommodating said latch assembly therein, said recessed portion having a cut out therein for facilitating access to said keeper by said pawl.

37. The latch assembly of claim 36, wherein said mounting means further comprises a mounting flange for facilitating mounting of said latch assembly onto a panel.

38. The latch assembly of claim 37, wherein said mounting flange has an aperture configured to accommodate said recessed portion, and a plurality of support elements for supporting said mounting flange on one of said first and second panels.

* * * * *

UNITED STATES PATENT AND TRADEMARK OFFICE

CERTIFICATE OF CORRECTION

PATENT NO. : 6,048,006 
DATED : April 11, 2000
INVENTOR(S) : Jeffrey L. Antonucci, Ralph C. Ulisse and Christopher J. Pinkow It is certified that error appears in the above-identified patent and that said Letters Patent is hereby corrected as shown below:

Column 2,
Line 45, after "present invention", -- is -- should be added.

Column 3,
Line 4, after "Fig. 6b is", -- a -- should be added.

Signed and Sealed this

Twenty-fourth Day of May, 2005

JON W. DUDAS
*Director of the United States Patent and Trademark Office*